US005273320A

United States Patent [19]

deMaCarty

[11] Patent Number: 5,273,320

[45] Date of Patent: Dec. 28, 1993

[54] GARDENING INFORMATION KIT

[76] Inventor: Kathleen deMaCarty, 80 Starrs Plains Rd., Danbury, Conn. 06810

[21] Appl. No.: 823,263

[22] Filed: Jan. 16, 1992

Related U.S. Application Data

[63] Continuation-in-part of Ser. No. 560,604, Jul. 31, 1990, abandoned.

[51] Int. Cl.[5] ..... B42D 15/00

[52] U.S. Cl. ..... 283/65; 283/117

[58] Field of Search ..... 283/117, 49, 115, 65; 235/88

[56] References Cited

U.S. PATENT DOCUMENTS 4,248,458 2/1981 Brody ..... 283/117

4,984,825 1/1991 Fowler ..... 283/117 X

*Primary Examiner*—Mark Rosenbaum

*Assistant Examiner*—Willmon Fridie, Jr.

[57] ABSTRACT

A Garden information Kit has two elements which provide all the information necessary for successful planting, growing and harvesting of crops. The first element is a set of data cards both carrying information and having means to easily sort the cards carrying the desired information. The second element is a calendar calculation wheel used to determine when certain events are to be executed.

4 Claims, 3 Drawing Sheets

GARDENING INFORMATION KIT

CROSS REFERENCE TO RELATED APPLICATIONS

The present application is a continuation-in-part of the earlier patent application Ser. No. 07/560,604 filed Jul. 31, 1990 now abandoned.

THE FIELD OF THE INVENTION

The present invention relates to a Gardening Information Kit to be used in supplying the amateur or the advanced gardener with all relevant information regarding dates, planting, transplanting, growing, watering, fertilizing, spraying, harvesting and storing a wide variety of plants and vegetables.

BACKGROUND OF THE INVENTION

The Gardening information Kit was created due to a need for information while in the garden without reading volumes of reference material or bringing these books into the garden.

The home gardener grows many different plants and vegetables all with different protection, spacing and care needs. It is difficult if not impossible to commit all this information to memory. Therefore, the gardener will probably have to refer to his reference material. Some gardeners only have seed packets, some have an extensive library. Most of the seed packets do not provide the appropriate information needed for the many tasks to complete harvest. It is difficult to bring these reference books into the garden without some damage. After the gardener reads his reference material, how does he easily bring this information into the garden. Many questions go unanswered.

When to plant is probably one of the most important questions that a gardener asks. Most gardeners try to push the season and plant as early as possible. If the gardener plants frost sensitive vegetables too early, destruction of the crop will be the result. He must know what to plant and when. A tool was needed that could give him the correct information about when to plant for any latitude in the country or internationally, be user friendly and at the same time provide a calendar.

There has been a recent increase in public awareness of the health benefits of organic gardening, especially vegetable gardening (defined as gardening without the use of petro-chemically based herbicides, fungicides, pesticides, and fertilizers that have been associated with the causes of many health problems including cancer). The organic method biologically enhances the soil, avoids pollution and creates an environment which is healthy for the gardener and his family. The awareness level of protecting us from the use of dangerous pesticides has even reached the petro-chemical industry. Even Ortho, a subsidiary of Cheveron, now producing a line of organic products. It certainly means that there is a base of consumers who prefer the organic to the petro-chemical products.

Many people subscribe to the use of organic gardening techniques in home vegetable gardening. However, many people who try home vegetable gardening, especially first timers, are not sufficiently experienced and have not been exposed to the methods that are actually simple. There is also a preconceived notion that organic gardening methods are difficult and result in poor quality produce. Most gardeners are not aware that there are easy alternatives to the petro-chemical industry's herbicides, fungicides and pesticides. In fact most garden pests can be managed by natural, barrier, botanical and biologically commercially available products. There have been many books written on the subject of gardening, but few on organic gardening as compared to the plethora of information available. Education is needed in order to change over to organic gardening. This can be a deterrent to practicing organic gardening.

Some of the more important questions that concern gardeners are, ie.: which vegetables are prone to be killed by the frost, which can be planted for Fall harvest, or which need to be started indoors. The ability of this kit to sort the data cards without reading each individual card to answer these kinds of questions is invaluable. A kit was needed that could sort out specific questions and pieces of information.

The summary of the above problems are as follows: how does one summarize and transfer the information with an organic orientation, how does one avoid bringing books into the garden, how does one manipulate planting dates for the gardener's specific locale, how does one sort information quickly and how does one minimize the waisting of time. The Gardening information Kit solves these problems with its two components.

The kit combines 2 elements which serve different functions yet when combined together they create a complete source of information for every aspect of growing the target vegetable or plant including dates and the hows of germination, starting seedlings indoors, transplanting, planting, watering, spraying, harvesting and storage.

1. It summarizes information concerning each vegetable as completely and as clearly as possible, free from clutter and in a form which the gardener can use effortlessly.

2. It gives the home gardener the ability to have a user friendly sorting system similar to a data base at his fingertips right i the garden. In the present embodiment there are 44 specific pieces of information available, presented on the vertical sides, but not limited to, of a standard sized paper, for example. Categories for the storing stations are determined by the subject matter of the kit, ie. vegetables or perrenial flowers.

3. The circular calendar calculator gives the gardener the ability to manipulate specific dates for his specific locale and for specific vegetables and/or plants. It can be used to determine when to start seedlings, when to plant directly into the garden, when to transplant seedlings, when to discontinue planting, when is the expected harvest date, and to determine if there is enough time for another crop before Fall frost. This is all executed by gardeners anywhere in the country. The only piece of information that the gardener needs to provide are the dates of the first and last frost.

4. It addresses the principal aims of organic agriculture as adopted by the International Federation of Organic Agriculture Movements.

U.S. Pat. No. 3,316,668, issued to Rogers on May 2, 1967, disclosed an adjustable garden chart which is a device for correlating information recorded on a plurality of indicia bearing strips. Although Rogers' design allows one to retrieve information regarding the growing of certain crops, He uses strips and reels which can be moved together or independently. His device could also be applied to finding the constellations int he various skies throughout the year.

U.S. Pat. No. 4,248,458, issued to Brody on Feb. 3, 1981, is a device used in the field of horse racing. Its object is to randomly select the horses for Win, Place, Show, Daily Double, Quinella, Perfecta, and/or Trifecta without the seu of publications and authoritative sources. This device uses three concentric circles with indicia; however, it also contains a face plate with "equicircumferentially distributed presentation openings" for the above betting selections and also contains a bottom cover for a total of five wheels. The indicia which can be seen thru the face plate openings are only used after the three wheels have been arbitrarily moved by manipulating them on the reverse side. It is then that the bettor turns this device to the obverse side to reveal the numbers of the individual participants. The information indicia contained in the embodiment of the circular calendar calculator responds to the specific problem of planting dates (from the earliest planting date to discontinuation). Not only does this kit manipulate multiple indicia, but unlike Brody, it acts as an informational source. Six distinct items can be determined by the circular calendar calculator unlike Brody's which only reveal one, the numbers of participants matched with the type of betting possibilities.

SUMMARY OF THE INVENTION

It is an object of the present invention to provide a kit of gardening information which is user friendly in that it provides substantially all of the information necessary for the home gardener to successfully raise vegetables.

It is a further object of the present invention to provide a kit having several components which the gardener can selectively use on site, in the garden, in any weather and the allows immediate access to all the information necessary, in a timely fashion, to accomplish those tasks necessary for the successful growth and harvest of crops and/or plants.

It is still another object of the present invention to provide a Gardening Information Kit that contain several components which are useful both independently and in combination to successfully plan, plant, raise and harvest vegetables.

The subject invention comprises a two component system, namely (1) data cards with information concerning growing information for a variety of vegetables, which data cards can be mechanically sorted according to particular categories of information contained on the face sorting card; (2) a circular calendar calculator wheel to determine specific information regarding optimum task execution dates throughout the calendar year.

While it is contemplated that the gardening information kit will aid the organic gardener, the system can also be used for all types of gardening, i.e. vegetables, fruit and flower, whether or not organic methods are utilized.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
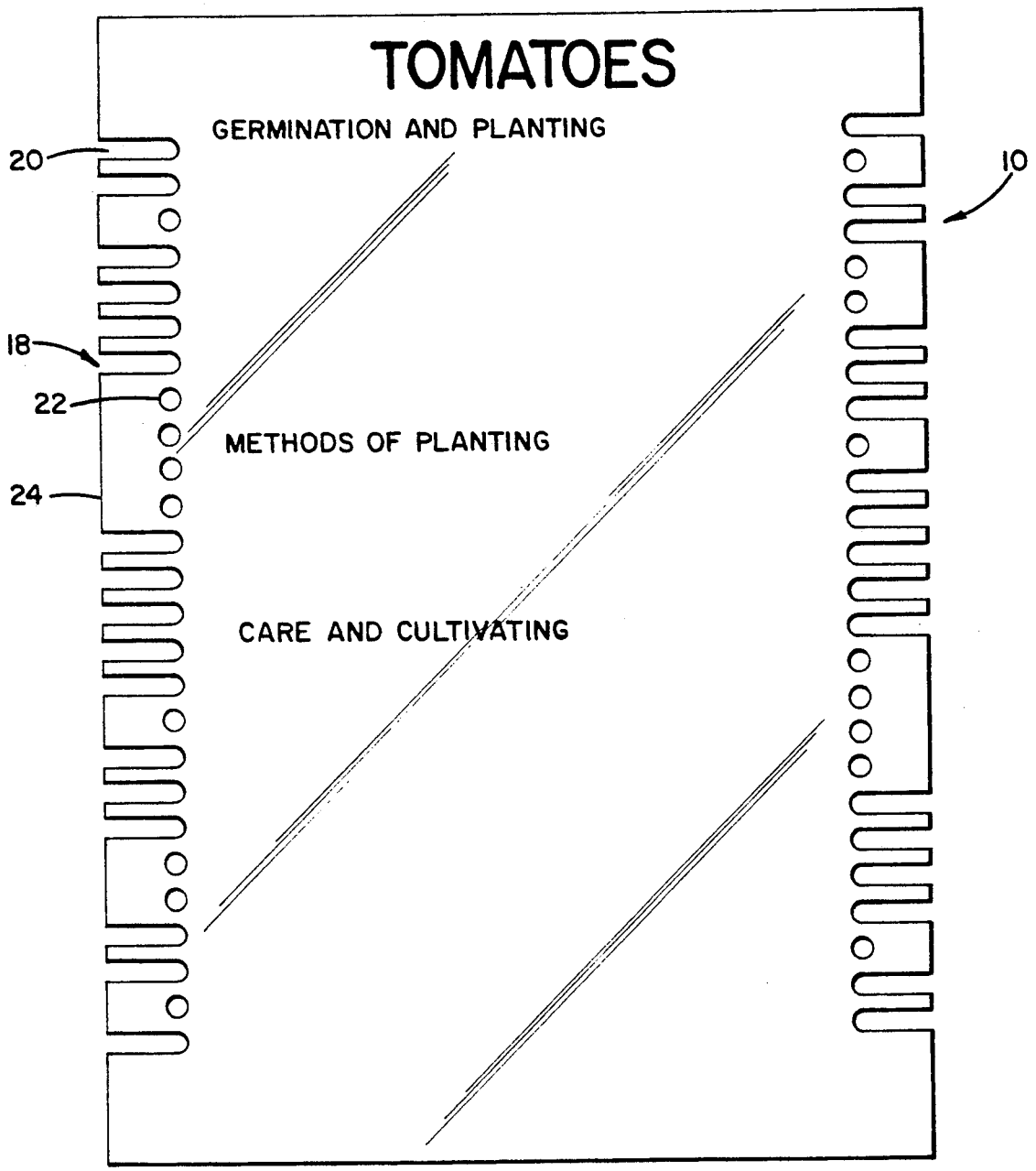
FIG. 1 is a plan view of the obverse of a data card of the present invention.
Figure 2:
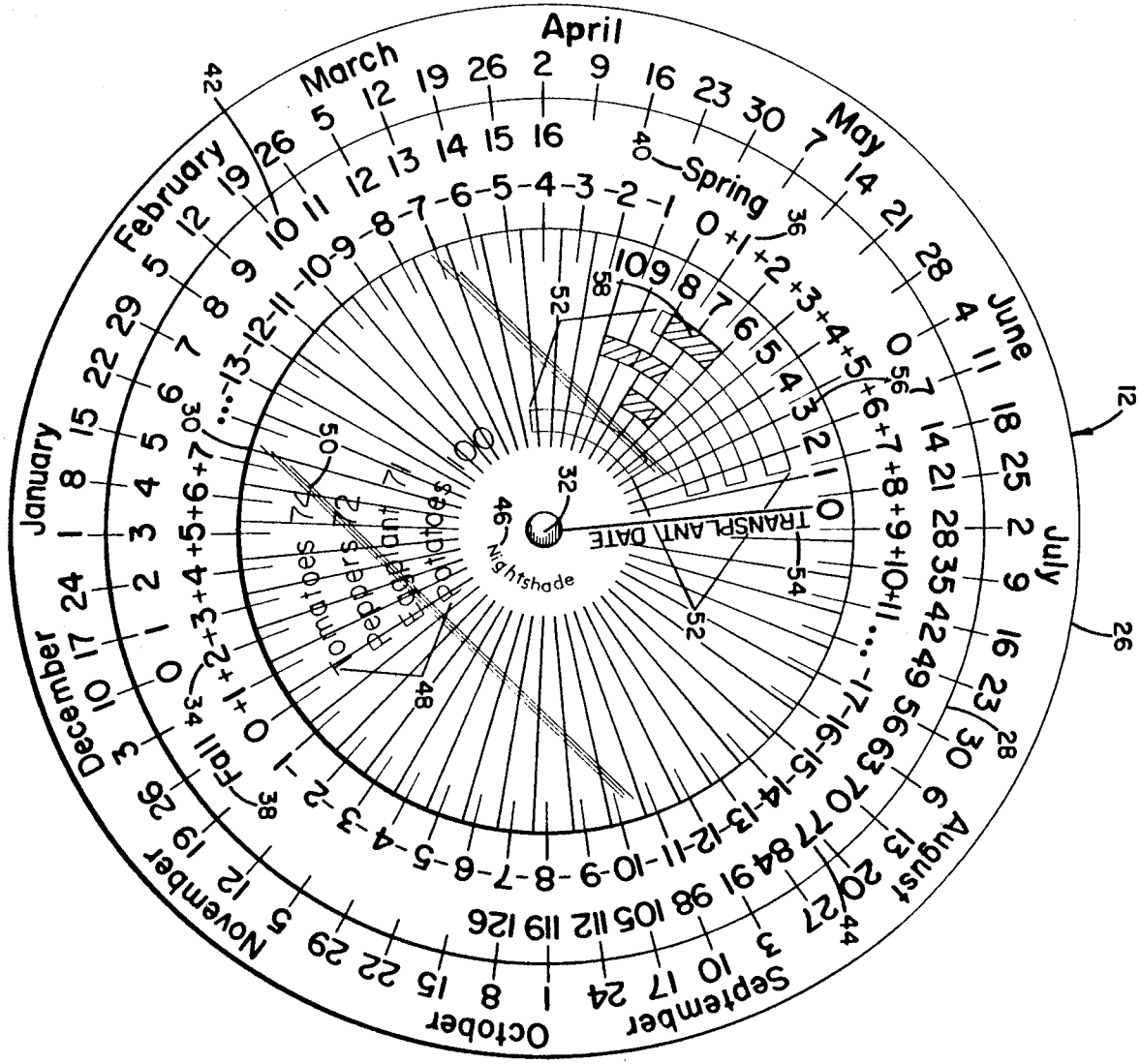
FIG. 2 is a plan view of a calendar calculator wheel of the present invention.

The present invention is a Gardening Information Kit designed to readily provide the novice or advanced gardener with all relevant information needed to plan, plant, grow, maintain, harvest and store a wide variety of plants and vegetables. It would be here noted that the terms "plans" and "vegetables" are being used in a generic sense and would include all the things an average homeowner might want to grow on his property, such as herbs, flowers, shrubs, trees and ornamental plants, as well as plants and vegetables normally growth for human consumption. It should also be noted that the words "major category" are assigned the meaning of the grouplings of indicia in the main body of the data card and that the words "sorting category" are assigned the meaning of information that can be retrieved by inserting the sorting tool into the stations of holes 22 and slots 20. The subject kit has two primary components, namely (1) a plurality of data cards, as shown in FIG. 1; (2) at least one calendar calculator wheel, as shown in FIG. 2;

Turning first to the data cards 10 of FIG. 1, the data card is preferably of sufficient size to hold a lot of data, for example 8.5×11" or conventional letter size. The data is preferable a laminate formed by plastic coatings on both sides of a printed sheet of paper or printed on plastic laminate similar to a credit card. This provides a certain amount of rigidity and durability for the data card which is necessary for the task of repeated sorting.

Information is provided on both the obverse and reverse of each data card according to several major categories of information, such as but not limited to "Temperatures and Germination", "Dates", "Apperance", "Planting and Transplanting Procedures", "Planting Methods", "Thinning", "Soil", etc. as illustrated on the obverse in FIG. 1. There may be as many as 18 or more major categories or groupings of informational indicia depending on need. Each data card 10 contains information specific to the plant or vegetable that is described and/or illustrated on the top of the data card, Tomatoes in the illustrated example.

In order to manually sort the data cards 10 by any one of a number of sorting categories, each data card is provided with sorting means 18 formed by a plurality of holes 22 and slots 20 arrayed along at least one marginal edge 24 of each data card. Besides being able to sort the various families or groups of vegetables, this system allows for selecting, ie: "All cool weather vegetables", "Seedlings started indoors", "Vegetables that tolerate shade", "Vegetables that are heavy feeders", or "Vegetables that are attacked by the squash vine borer", etc. Many other sorting categories may be included or substituted. The patterning of holes and slots is unique for each data card but the positioning stations of all holes and slots on all cards is identical. All positions or stations will be numbered and a face card with the numbered indicia will be provided. Thus, to select any particular piece of sortable information or specific group of data cards, one looks up the corresponding number, inserts an elongated blunt instrument, such as a needle or rod (not shown) into the selected numbered position and passes the sorting tool through the aligned holes 22 and slots 20 of the data cards 10 making up the stack. It is assumed that the desired edge 24 is in the top most position. The needle or rod is then moved vertically out of the stack to pass out of the slots of those data cards which are not in the selected sorting category while carrying along the data cards having holes, as opposed to slots, at the selected position or station.

For example, if someone desired all vegetables that need to be started indoors, they would first check to make sure that all the data cards 10 were facing in the same direction, look up the correct number on the face card, then they would insert an instrument, such as the above mentioned elongated blunt needle, into the select numbered position of a stack of data cards. The remaining data cards which do not apply to the selection are left behind in the stack until needed. When it comes time to return the data cards to the stack, it is not necessary to locate their original position in the stack or reinsert the data cards in any particular order. The used data cards can simply be placed, facing the same direction, in any order in the stack as the sorting system of the present invention allows them to be recovered any time form any order. This unique sorting system of the present invention allows access to a large quantity of information which has been presorted, while being easy to manipulate since the order of the data cards is not a factor in recovering the desired data cards.

The above identified categories are only illustrative of the major and/or sorting categories contemplated by this invention. Many other categories could be included or substituted.

FIG. 2 illustrates a circular calendar calculator wheel 12. The wheel 12 is preferably made of at least semi-rigid plastic or plastic coated material with a waterproof surface bearing the calendar informational indicia. Preferably the wheel 12 is of such a size to be able to contain information to be easily read, however, small enough so as not to make the calculator cumbersome to handle. Preferably, the outside dimension of the wheel 12 will be less than 8½". The outter edge of the middle wheel 28 will be of such dimension as not to hide the indicia of the outer wheel 26 and some of the radiating spokes This allows the user of this tool to align the radiating spokes of the various wheels. The outter dimension of the inner wheel 30 should be less that the inside dimension of the most inner set of numbers 34, 36 of the middle wheel 28.

This calculator wheel 12 consists of three concentric and coaxially rotatable mounted circular calculator discs; (1) the outside disc 26; (2) the middle disc 28; and (3) the inner disc 30 all relatively rotatable secured together by hub 32. It is contemplated that there could be a calculator wheel for each general family or grouping of vegetable or plants.

Figure 5:
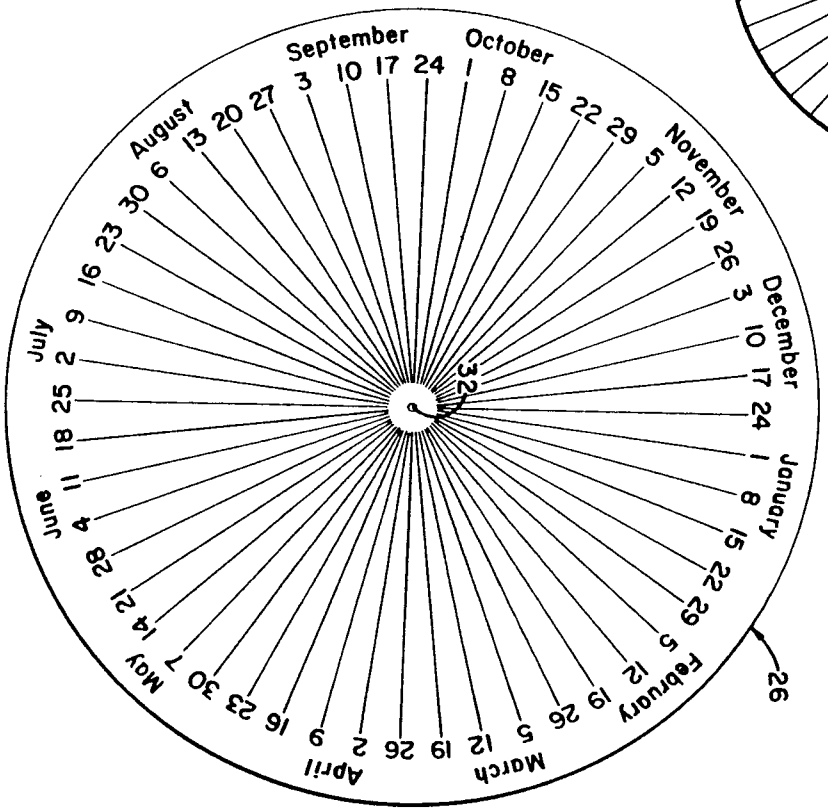

The outside disc 26 FIG. 5 carries notations relating to the calendar year. It is preferably broken down into fifty-two accurate and equal portions which are in 7 day increments. The indicia which correlates to these lines will follow the calendar year, starting on January 1 and continues as follows: January 8, 15, 22, 29, February 5, 12, 19, 26, etc.

Figure 4:
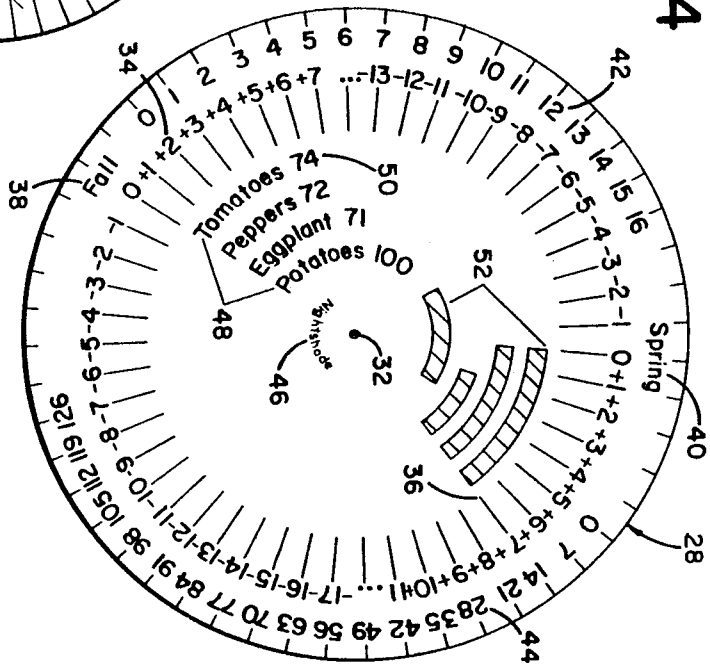
FIGS. 3–5 are elevational views of the outter, middle and inner discs forming the calendar calculator wheel of the present invention.

The middle disc 28 FIG. 4 carries several sets of numbers in two concentric configurations for ease of calculation. The inner set of numbers 34 and 36 substantially completely encircling the middle disc 28 and spaced inwardly from its parameter. Each arcuate set of numbers 34 and 36 are designated plus (+) and Minus (−) numbers going clockwise and counterclockwise, respectively, from two nearly opposite zero points. These sets of numbers represent weeks before (−) and after (+) the Spring 40 and Fall 38 frost dates. Additional outer number sets 42 and 44 help in determining the number of days to a particular desired event, ie. days to harvest or the number of frost free days until the Fall frost. This is accomplished by selecting either the list 42 or 44 and then placing that zero of the selected list on the starting date which is found on the outter disc 26. Both of these sets of numbers are located on the outer perimeter of disc 28. The number set 42 ranges from 0 weeks to 16 weeks (ie. 0 1, 2, 3, . . . 16). The number set 44 ranges from 0 days to 126 days in 7 day increments (ie. 0, 7, 14, 21 . . . 126). Each number for both sets 42, 44 corresponds to the spokes of the wheel. Also in the middle wheel 28 around the hub 32 occurs the name of the grouping or family 46 that is contained on this individual wheel. Concentrically radiating inward from 34 and 36 are the names of the individual vegetables 48 contained on this individual wheel. Directly next to the names of the vegetables are numbers 50 which indicate either the number of days from transplant to harvest or the number of days from direct seeding to harvest. To the right and in line are shaded areas 52 which indicate the range of time when the vegetable may first be placed in the ground either as a seed or transplant and the end of this shaded area to the extreme right indicates the number of weeks to cease planting after the Spring frost or the number of weeks to cease planting before the first Fall frost.

These areas will be shaded different colors or marked in some way as to indicate the difference between direct planting and those vegetables that may be stared as seedlings outside the garden, ie. in a greenhouse. It is in the latter case that the inner wheel 30 will be used.

Figure 3:
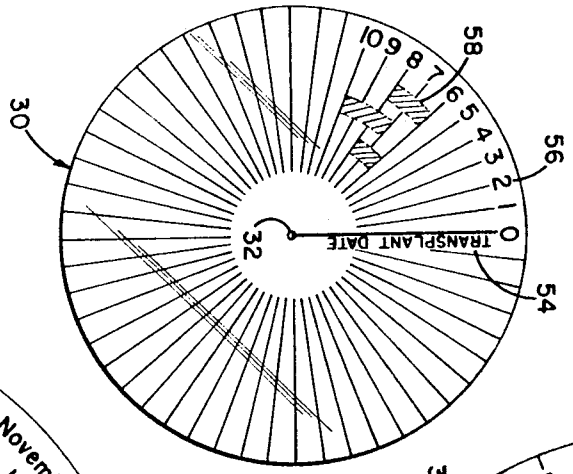

In the preferred embodiment the inner wheel 30 FIG. 3 is made of transparent material with sufficient thickness as to be able to withstand multiple manipulations. Fifty - two lines radiate from the hub 32 as was mentioned above. One of the lines will appear thicker than the others and will labeled the Transplant Date 54 and marked with zero. Moving to the left each line will be numbered 56 starting with 1 and continue, for example to ten. These numbers which correspond to time units (weeks) will be used in conjunction with the shaded areas 52 of the middle circle 28. Hatched areas 58 on the transparent inner circle 30 will indicate the number of weeks before transplant that the gardener is to start his seedlings indoors (ie. for Tomatoes it's 6–8 weeks before transplant). Vegetables that are only to be planted outside will not have a hatched area 58 on the transparent inner circle 30 directly over the corresponding vegetable 48.

The following is a description of how to determine the date for starting, seedlings, when to transplant and when to expect the beginning of the harvest ie. Tomatoes. It is assumed that the last killing frost will occur before April 30th. The gardener wants to place out the seedlings as early as possible without the danger of frost.

1. Place the Spring 40 zero under the date April 30th, aligning the spokes of the wheels 26 and 28.

2. Align the Transplant Date line 54 of the inner wheel 30 with the extreme left edge of the shaded area 52 on the middle wheel 28. This is the earliest this gardener can plant safely for this area.

3. Look for the vegetable name 48 (Tomato) and follow the radius around to the left until the hatched area 58 of the inner circle 30.

4. Note that the hatched area 58 falls between the numbers of six and eight 56 on the inner circle 30. Continue following these radiating lines up to the dates of the outter circle 26. Seedlings may be started indoors between the dates of March 5th and March 19th when transplanted on April 30th and will be six to eight weeks old.

5. The name of the vegetable 48 Tomato has the number seventy-four 50. This number indicates the average number of days from transplant to harvest.

6. Align the zero 44 of the middle circle 28 to the date April 30th, the transplanting date. The number seventy-four falls between the numbers seventy and seventy-seven 44 printed of 28. The expected start of the tomato harvest is approximately July 13.

In use the wheel is designed to instantly yield the following information

1. The date (or dates) on which one should start seedlings based on the last frost date.

2. The date (or dates) on which one should transplant the seedlings.

3. The date (or dates) on which one should plant directly in the garden.

4. The average number of days from seed to harvest or from transplant to harvest.

5. The approximate dates one should harvest the vegetables.

6. The possibility of succession planting may be determined by calculating the approximate number of frost free days between the harvest of the first crop and the harvest of the second crop.

It is contemplated that, in use, the device of the present invention will provide the gardener will accurate information, easily readable, and in a format that will be rewarding to his efforts. Since information derived from this calendar calculator wheel is based on local frost dates which are supplied by the gardener, the wheel is substantially universal in application without regard to the planting zone.

While there has been described what are at present considered to be the preferred embodiments of the invention, it will be obvious to those skilled in the art that various changes and modifications may be made therein without departing from the invention and it is therefore aimed too cover all such changes and modifications so as to fall within the true spirit and scope of the invention.

What is claimed is:

1. A kit for garden information comprising:

a plurality of data cards;

at least one calendar calculator wheel:

wherein each said data card has sorting means provided along at least one marginal edge whereby specific cards or groups of cards can be with drawn from randomly stacked stat cards, and wherein said sorting means comprise an array of designated locations, each location assigned to particular sorting category of gardening information on said data card and having thereat a hole spaced from said marginal edge or a slot extending to said edge, whereby passing an elongated tool through a selected location in a stack of data cards and moving said tool transversely of said stack will cause all of those cards bearing the desired information, as represented by a hole, to be removed leaving those cards without the desired information, as noted to a slot, in the stack.

2. A kit according to claim 1 wherein each said array of holes and slots being unique to a specific vegetable and or plant described on said data card.

3. A kit according to claim 1 wherein each said data card is constructed with sufficient rigidity as to enable repeated sorting

4. A kit for garden information comprises a plurality of data cards; at least one calendar calculator wheel at least three discs concentrically and coaxially mounted on a single hub, one of said discs bearing indicia representative of the calendar year, another of said discs bearing indicia representative of Spring and Fall frost dates and time periods before and after said frost, dates, said disc further bearing indicia indicative of time units until harvest or other objective, and lastly this disc also contains indicia relating to starting and the finishing of planting and the third of said discs bearing indicia to be used in setting and selecting from the other two discs.

* * * * *